United States Patent [19]

Kerrebrock

[11] Patent Number: 4,506,634

[45] Date of Patent: Mar. 26, 1985

[54] INTERNAL COMBUSTION ENGINE

[76] Inventor: Jack L. Kerrebrock, 108 Tower Rd., Lincoln, Mass. 01773

[21] Appl. No.: 411,623

[22] Filed: Aug. 26, 1982

[51] Int. Cl.[3] ..... F02B 33/00

[52] U.S. Cl. ..... 123/68; 123/53 R

[58] Field of Search ..... 123/53, 59 EC, 68

[56] References Cited

U.S. PATENT DOCUMENTS

| | | | |
|---|---|---|---|
| 691,017 | 1/1902 | Thomson | 123/53 A |
| 1,114,521 | 10/1914 | Reese | 123/68 |
| 1,273,834 | 7/1918 | Dumanois | 123/53 B |
| 1,372,216 | 3/1921 | Casaday | 123/68 |
| 1,512,673 | 10/1924 | Breguet | 123/68 |
| 1,609,371 | 12/1926 | Leissner | 123/68 |
| 2,122,398 | 7/1938 | Harrison | 251/335 B |
| 2,415,507 | 2/1947 | Mallory | 123/53 A |
| 4,159,700 | 7/1979 | McCrum | 123/59 EC |

FOREIGN PATENT DOCUMENTS

| | | | |
|---|---|---|---|
| 1140686 | 1/1969 | United Kingdom | 123/53 R |

*Primary Examiner*—Craig R. Feinberg

*Attorney, Agent, or Firm*—Lahive & Cockfield

[57] ABSTRACT

An engine in which the compression and expansion functions are separated to enable: higher efficiency by eliminating inlet throttling, providing stable lean combustion of premixed or injected fuel, by allowing more complete expansion and reduced heat transfer during both compression and expansion; wide fuel compatibility by elimination of detonation and autoignition requirements of spark ignition engines and Diesel engines; lower emissions achieved in combustion of uniform fuel-air mixtures by mixing into hot recompressed combustion products.

19 Claims, 9 Drawing Figures

INTERNAL COMBUSTION ENGINE

BACKGROUND OF THE INVENTION

This invention relates to an improved form of internal combustion engine, which offers increased efficiency, the ability to utilize a wide range of fuels, improved control of pollutants, and greater simplicity of construction relative to engines in use or formerly proposed.

SUMMARY OF THE INVENTION

The engine, new and novel in concept, will be entitled the Separated Compression and Expansion Engine (SCEE). One possible implementation of it is shown in FIG. (1). It is composed of pairs of cooperating positive displacement devices, one in each pair serving to ingest and compress air or an air-fuel mixture, the other of the pair serving to expand the combustion products, then exhaust them to the atmosphere. The first, 1 hereafter called the compressor, is provided with an intake valve or port 2 of conventional form, and the latter, 3 termed the expander, is provided with an exhaust valve or port 4, conventional except as to its timing as described herein. The compressor 1 and the expander 3 are connected by a transfer passage 5, short and of minimum practical volume, provided with a control valve 6 whose purpose is to control the transfer of compressed air or air-fuel mixture from the compressor to the expander. The compressor and expander operate synchronously, in such a way that the expander reaches its minimum volume before the compressor does. As the expander volume increases, the air or air-fuel mixture is passed from the compressor, whose volume is decreasing, through the transfer passage to the expander, the volume of the gas charge being substantially constant during the transfer. As the air, to which fuel will have been added in passage through the transfer port, or the air-fuel mixture, enters the expander, it combusts by virtue of contact with hot combustion gases remaining in the expander 3 from the last cycle of operation, and recompressed to a pressure equal to that of the air or air-fuel mixture prior to its transfer. The minimum (clearance) volumes of both compressor and expander are as small as practical, the effective volumetric ratio of compression of the charge being controlled by the phase lead of the expander relative to the compressor, larger leads corresponding to lower compression ratios.

In the preferred implementation, the displaced volume of the expander 3 exceeds that of the compressor 1, so as to provide more complete expansion of the combustion products than is possible in conventional internal combustion engines in which compression and expansion occur in the same displacer.

Without preference, the fuel may be added to the air by carburetion 7 prior to induction by the compressor, or it may be injected 8 into the high pressure air as it is passed from the compressor to the expander through the transfer port.

An object of this invention is to separate the functions of compression and expansion so that the volumetric expansion ratio can be larger than the volumetric compression ratio, allowing expansion of the combustion products as nearly as practical to atmospheric pressure, with a concomitant increase in efficiency relative to engines with equal expansion and compression ratios.

A second object of this invention is to enable the use of a wide range of fuels, by separating the compression and expansion functions, and providing for controlled combustion during the transfer from compressor to expander. When an air-fuel mixture is compressed, the preignition (anti-knock) requirements of the fuel are much reduced by the fact that the air-fuel mixture contacts only the relatively cool compressor during compression, and is combusted by mixing with the hot exhaust gases as it flows into the expander, rather than by progress of a flame front in a relatively stagnant gas mixture, as in conventional Otto engines. When fuel is added in the transfer passage 5, the air-fuel mixing and fuel vaporization occur prior to combustion of the mixture by mixing with hot combustion products. In this case the requirements for autoignition are less severe than for a Diesel engine fuel, where combustion must commence upon injection of the fuel into relatively cool air at the end of compression.

A third object of this invention is to reduce the formation and discharge of pollutants. These may be characterized as carbon monoxide, unburned hydrocarbons, nitrogen oxides, and particulates. In comparison to the conventional Otto engine, the SCEE when operated on a compressed air-fuel mixture offers a reduction of carbon monoxide and nitrogen oxides without recourse to after-treatment. Because of the positive ignition mechanism inherent in discharge of the air-fuel mixture from the transfer passage into hot recompressed exhaust gases, mixtures with less than stoichiometric fuel-air ratios can be reliably used. The resultant excess oxygen reduces the production of carbon monoxide. It also lowers the peak combustion temperature, thus reducing the production of nitrogen oxides. The production of the nitrogen oxides are further reduced by the rapid expansion which occurs as a result of the lead of the expander piston 21 relative to the compressor piston 22. In comparison to the conventional Diesel engine, the formation of unburned hydrocarbons and particulates is reduced by virtue of the ordered vaporization and mixing of the fuel as it is injected into the transfer passage. This eliminates both the formation of overly rich regions and the heating and cracking of liquid fuel which occurs when liquid droplets are sprayed directly into a region of oxygen rich combustion products.

A fourth object of the invention is to minimize heating of the air or air-fuel mixture during compression, and to minimize heat loss from the combustion products during combustion and expansion, thus maximizing the thermodynamic efficiency of the engine. Since the compressor 1 does not contact the combustion products its internal surfaces will seek some mean of the temperatures encountered during compression, or they can be further reduced by cooling. By utilizing temperature resistant materials for the expander 3, its internal surfaces can be made to seek a mean of the combustion and expansion temperatures of the combustion products, thus minimizing the heat loss, and improving the efficiency of the engine.

A fifth object of the invention, when utilizing a compressed air-fuel mixture, is to enable operation over a wide range of load without throttling of the air-fuel mixture, thus reducing the pumping losses suffered by the conventional Otto engine. This is achieved by reducing the fuel-air ratio at part load conditions, reliable ignition and combustion being provided by mixing of the compressed air-fuel mixture with the recompressed combustion products upon transfer from the compressor to the expander.

A sixth object of the invention is to maximize the efficiency of the engine by assuring that all processes are as nearly reversible, in the thermodynamic sense, as possible. To this end, heat transfer both to and from the working fluid during compression and expansion is minimized, by separation of the compression and expansion functions, and by insulation of the inner expander surfaces. To this end also, transfer of air or air-fuel mixture from the compressor 1 to the expander 3 occurs after equalization of pressures in these two components, and with as low a velocity and pressure drop through the transfer port 5 as is consistent with satisfactory mixing of combustible mixture and combustion products.

FIG. *3a* and FIG. *3b* are cross-sectional schematic drawings for two alternative transfer valves for my engine.

Figure 1:
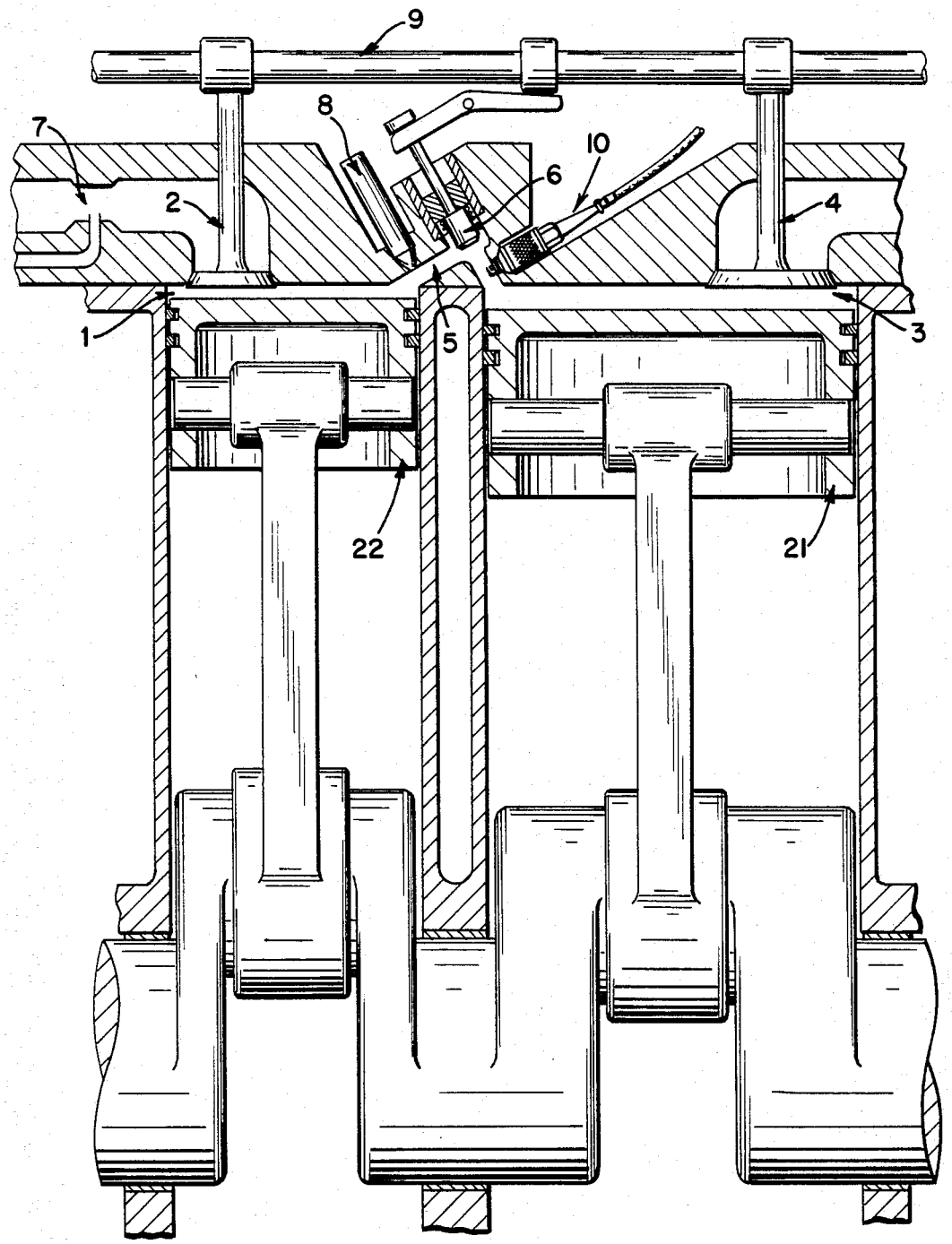
FIG. 1 is a cross-sectional schematic drawing depiction of my engine, showing the cooperating compressor and expander, the connecting passage and transfer valve, and inlet and exhaust valves.
Figure 2:
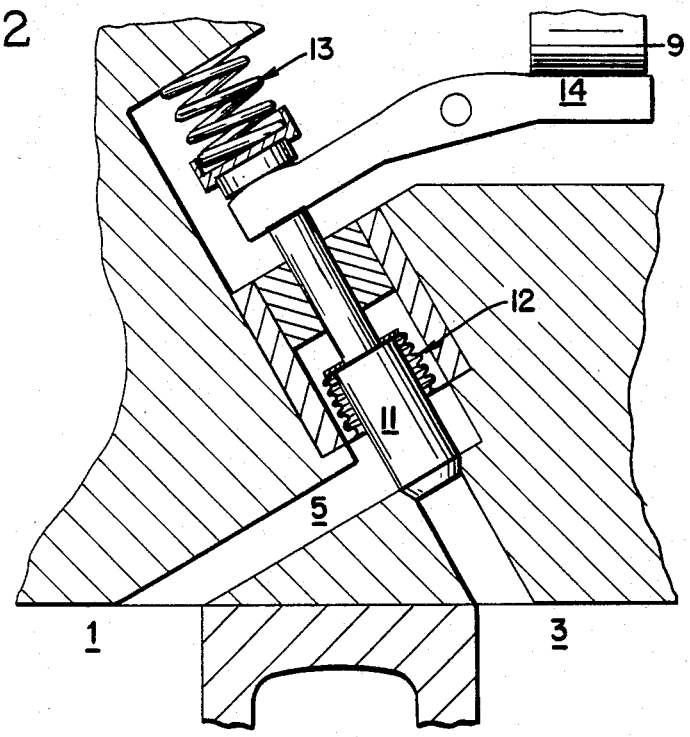
FIG. 2 is a cross-sectional schematic drawing of a transfer passage and valve, for my engine employing a bellows means.
Figure 3A:
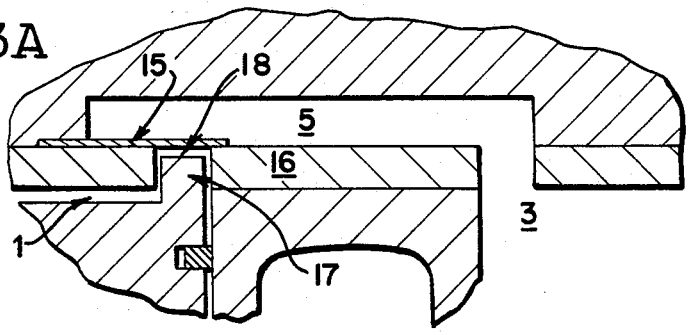
Figure 3B:
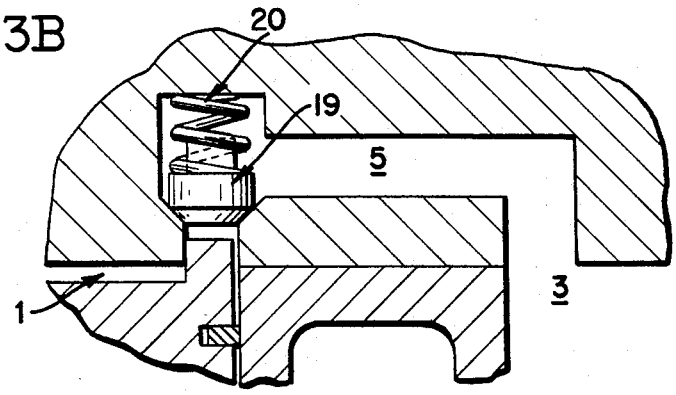
Figure 4:
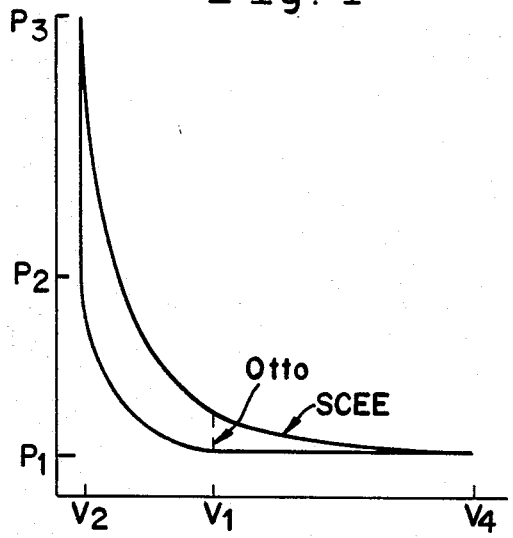

FIG. 4 is a thermodynamic diagram of my engine cycle on pressure (P) and volume (V) coordinates, compared to the conventional Otto cycle.

Figure 5:
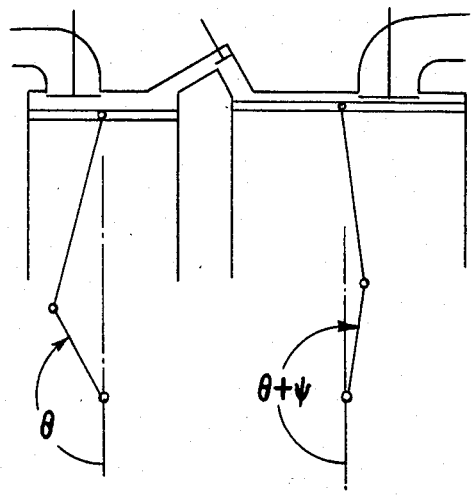

FIG. 5 is a schematic diagram of my engine showing the phase lead angle of the expander relative to the compressor.

Figure 6:
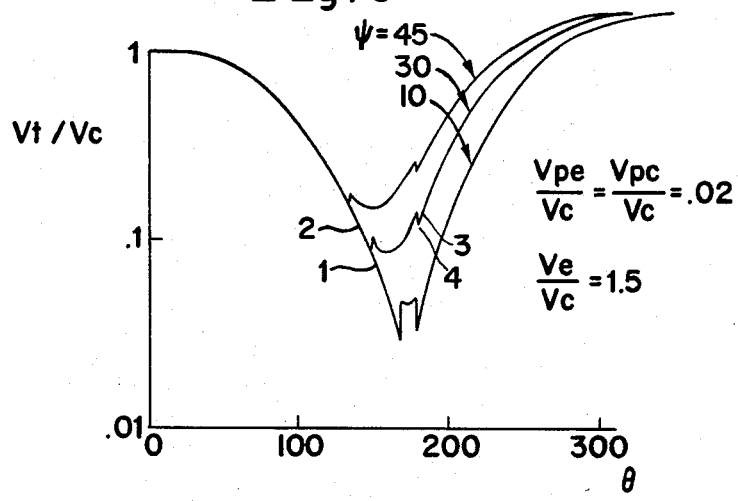

FIG. 6 is a set of curves depicting the variation of the ratio of total volume (Vt) to compressor volume (Vc), with angular position of the crank, for various values of the phase lead angle (degrees).

Figure 7:
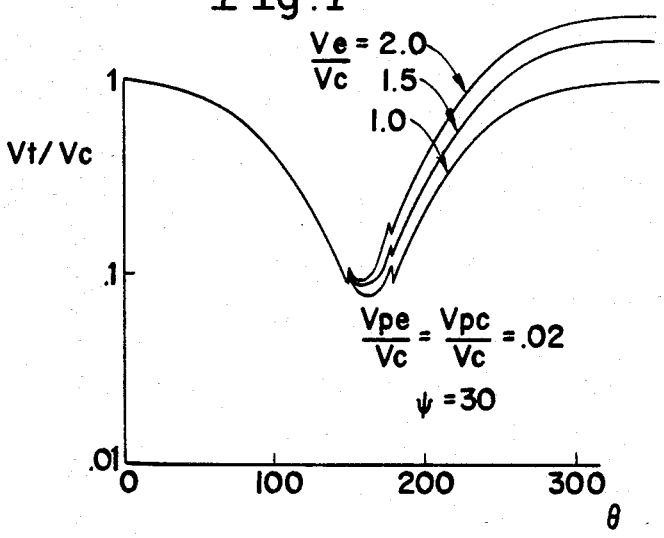

FIG. 7 is a set of curves depicting the variation of the ratio of total volume (Vt) to compressor volume (Vc), with angular position of the crank, for various values of the ratio of expander volume (Ve) to compressor volume (Vc).

Figure 8:
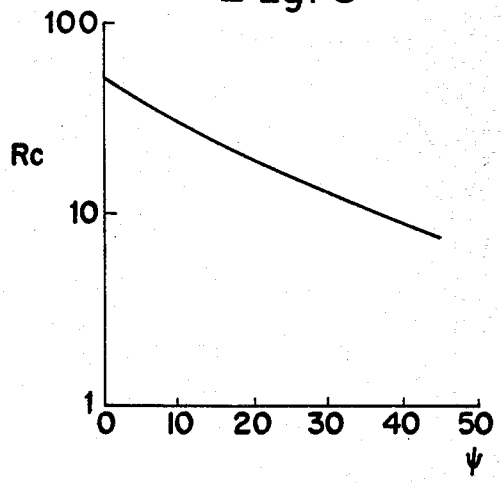

FIG. 8 is a curve depicting the effective compressor ratio Rc of my engine as a function of the expander phase lead angle (degrees).

DESCRIPTION OF THE PREFERRED EMBODIMENTS

The general principles and objectives given above can be realized by a variety of mechanical arrangements, some of which will be described here. Their common features are: (1) a pair of cooperating positive displacement devices, operating synchronously with the expander leading by some phase angle, denoted $\phi$ in angular motion of the output shaft; (2) a transfer port connecting the compressor and expander, incorporating a control valve actuated either positively by an external mechanism or by gas pressures against its two sides; (3) suitable intake valves or ports for the compressor and exhaust valves or ports for the expander; (4) suitable means for carbureting an air-fuel mixture at the compressor inlet, or for injecting fuel into the transfer port.

One preferred implementation utilizes dual piston-cylinder mechanisms arranged as shown in FIG. (1), to operate from a single crankshaft with cranks angularly displaced to give the expander the desired lead, $\phi$. In this arrangement the transfer passage 5 and transfer valve 6 are conveniently located in the axial space between the compression and expansion cylinders and the transfer passage can be of small volume, as is essential. The intake 2, exhaust 4 and transfer 6 valves are conveniently located in a cylinder head and operated by a camshaft 9 as is common practice. This configuration has the advantage of requiring a minimum of modifications to conventional engine structures. Thus, an in-line four cylinder engine would provide two compressor-expander pairs, a six cylinder in-line engine three, and a V-8, four.

For starting, the transfer passage 5 is fitted with an electrical ignitor 10, either a spark plug or glow plug as shown. After warmup, continuous operation is obtained by ignition of the combustible mixture as it flows into the hot recompressed combustion products in the expander.

Each pair of cylinders requires one intake 2, one exhaust 4, and one transfer 6 valve. The intake and exhaust valves are operated by a camshaft 9 in conventional fashion except that the camshaft rotates at crankshaft speed, since all the functions of each cylinder are repeated on each revolution (two stroke cycle).

The transfer valve 6 can be either pressure actuated or positively actuated. In the latter case, a key issue is the sealing of the actuation mechanism, since the valve transfers air or air-fuel mixture at the peak pressure of the engine. One possible construction is shown in FIG. (2). The valve stem 11 is sealed by the bellows 12, which is arranged so that the high pressure is in its interior. The transfer valve is held on its seat by the spring 13, which must resist the difference between the pressures in the expander 3 and the compressor 1 during the initial period of the expansion. The transfer valve is lifted at the appropriate time by the lever 14 actuated by the camshaft 9. In this construction, all the sliding or rubbing elements of the mechanism can be lubricated, and the lubricant is isolated from the gas passage by the bellows 12. Due to the small volume of the highly compressed air or mixture, both the dimensions and the lift of the valve are small relative to those of the intake and exhaust valves.

Two possible implementations of gas pressure actuated transfer valves are shown in FIGS. (*3a*) and (*3b*). Neither is preferred apriori, the choice to be determined by evaluations of their relative durability, resistance to flow, and response to gas pressures.

In the first implementation, flexible metallic spring plates 15 lie over holes in the plate 16 covering the cylinder. As the pressure in the compressor rises above that in the expander, the plates 15 deflect, allowing passage of the air or air-fuel mixture into the transfer passage 5. When the compression piston 22 reaches its extreme position and reverses, the spring plates 15 return to their flat position, sealing the holes and preventing return flow into the compressor. To minimize the clearance volume of the compressor, a protuberance 17 can be provided to fill the port 18. This protuberance can be a magnet, the spring plate being ferromagnetic, in which case more positive seating of the spring plate will be assured.

In the second implementation, a poppet type valve 19 is used, supported by and seated by a coil spring 20 of heat resistant material. The protuberance can be used in this case as well, as can the magnet for positive seating.

A second preferred implementation would use pairs of rotary displacers of the Wankel type, one for compression, another of greater diameter or length for expansion. In this case the phase angle $\phi$ would result from an angular displacement of the expansion rotor ahead of the compression rotor. By locating the expansion rotor immediately adjacent the compression rotor, a short transfer passage of low volume is feasible.

An alternate construction would utilize pairs of piston-cylinder mechanisms arranged in a V, the compression cylinders being in one bank of the V and the expansion cylinders in the other. In this case the angle between the banks becomes the phase angle $\phi$. This arrangement has the advantage that the connecting rods can operate on a single crankpin, but the disadvantage that the transfer passage may be overly long and of excess volume and cannot be conveniently housed in a single cylinder head.

The mode of operation of the SCEE will be described with reference to the implementation depicted in FIG. (1). It is to be understood that the same functions of the major elements will be present for alternate mechanical implementations.

Beginning with the compressor piston 22 at its outermost (bottom) position and the compressor cylinder 1 filled with air or air-fuel mixture, with the inlet valve 2 closed, the transfer valve 6 closed, the exhaust valve 4 open, and the expander piston advanced a crank angle $\phi$ on its inward stroke, the compressor piston 22 moves inward compressing the air or air-fuel charge, while the expander piston 21 displaces the exhaust products through the exhaust valve. At a crank angle determined such that the pressure of the recompressed combustion products will equal the desired compression pressure when the expander piston reaches its innermost position (and the compressor is at the angle $\phi$ from its innermost position), the exhaust valve 4 is allowed to close by the cam 9, trapping the residual combustion products in the expander cylinder. When the expander piston 21 reaches its innermost position, the transfer valve 6 opens, either because the pressure in the compressor cylinder 1 has reached that in the expander 3, for the gas actuated valves of FIG. (3), or because of positive action by cam 9 in the case of the positively actuated valve of FIG. (2). As the compressor piston 22 continues inward, and the expander piston 21 moves outward, the air or air-fuel mixture is passed through the transfer passage 5 into the expander 3, its volume plus that of the recompressed combustion products remaining nearly constant or expanding slightly. This flow continues until the compressor piston 22 reaches its innermost position, whereupon the transfer valve 6 closes, either by action of the cam and spring of FIG. (2) or by the lack of flow in the case of FIGS. (3*a*) and (3*b*).

As the air-fuel mixture passes from the transfer passage 5 into the expander 3 it mixes turbulently with the hot recompressed combustion gases, which provide a reliable source of ignition and stabilization of the combustion.

In the case of compression of an air-fuel mixture the fuel injector 8 of FIG. (1) is omitted, and the mixture is formed by a conventional carburetor 7 ahead of the intake valve 2. When the fuel is injected by an injector 8, the injection rate is adjusted so that the fuel rate is substantially proportional to the rate of air flow through the transfer port, giving rise to a nearly uniform air-fuel ratio in the combustible mixture. For special conditions such as very low loads this condition can be modified so that a minimum fuel-air ratio for stable combustion is maintained.

When the compressor piston 22 has reached its innermost position and the transfer valve 6 has closed, the compressor piston 22 moves outward a small distance until the pressure in the compressor equals that in the intake, whereupon the intake valve 2 opens to admit a new charge as the compressor piston continues outward. The expander piston 21 moves outward as well, expanding the combustion products until it reaches its outermost position, or the pressure in the expander reaches that in the exhaust port. Whichever occurs first, occasions the opening of the exhaust valve 4. This action can be achieved, for example, by lightly spring loading the valve closed and opening it positively by means of the cam 9, which also then controls its closing at the appropriate point on the inward stroke of the expander piston.

The expander piston 21 the moves inward, while the compressor piston 22 continues to its outermost position, whereupon the intake valve 2 closes and the cycle repeats.

An unique feature of the SCEE is the possibility which it affords to implement in a practical way a thermodynamic cycle having efficiency superior to that of the conventional Otto and Diesel cycles. The SCEE makes possible a cycle having approximately constant volume combustion, and approximately complete expansion.

In the ideal cycle, which will be compared to the ideal Otto cycle, the transfer from compressor to expander will be assumed to take place in an infinitesimal crank angle $\phi$ such that the total charge volume is constant during transfer and combustion (heat addition). The relative displacements of the expander and compressor will be assumed such that complete expansion to ambient pressure occurs in the expander.

The ideal cycle is then as depicted on FIG. (4). Commencing with the working fluid at ambient pressure and volume $V_1$, it consists of an adiabatic reversible compression to volume $V_2$, followed by constant volume heat addition which raises the temperature from $T_2$ to $T_3$ and the pressure from $P_2$ to $P_3$ where $P_3/P_2=T_3/T_2$, followed by reversible adiabatic expansion to $V_4$ which is such that $P_4=P_1$. The expansion ratio required to satisfy this condition is $V_4/V_1=(T_3/T_2)^{1/\gamma}$, where $\gamma=C_p/C_v$ is the ratio of specific heats at constant pressure and at constant volume.

The efficiency of this ideal cycle is given by $$\eta_{SCEE} = 1 - (T_1/T_2)\left[\frac{(T_3/T_2)^{1/\gamma} - 1}{(T_3/T_2) - 1}\right],$$

whereas the equivalent expression for the Otto cycle is $$\eta_{Otto}=1-(T_1/T_2).$$

Inasmuch as the quantity in square brackets in the expression for $\theta_{SCEE}$ is always less than unity for $\gamma>1$, $T_3/T_2>1$, $\eta_{SCEE}>\eta_{Otto}$. For typical values:

$$\gamma=1.4,\ V_1/V_2=10,\ T_2/T_1=(V_1/V_2)^{\gamma-1}=2.51,$$

$$T_3/T_2=3.45,\ V_4/V_1=2.42$$

$$\eta_{SCEE}=0.769,\ \eta_{Otto}=0.602.$$

Thus, the SCEE enjoys a substantial ideal efficiency advantage over the Otto engine, due to its larger expansion ratio.

In the schematic diagram of FIG. (5), let $V_c$ be the displacement of the compressor cylinder, $V_e$ that of the expander cylinder, and $V_{pc}$ and $V_{pe}$ their respective clearance volumes, that is the volume between the transfer valve and the pistons at their innermost positions. Let $\theta$ be the angular position of the compressor crank from bottom center, and $\theta+\phi$ be that of the expander crank, so that $\phi$ is the phase lag of the compression piston.

Denoting by $V_t$ the total volume of the charge undergoing compression, transfer or expansion, it follows that $$V_t/V_c=[(1+\cos\theta)/2]+(V_{pc}/V_c) \quad 0<\theta<\pi-\phi$$

$$V_t/V_c=\frac{1+\cos\theta}{2}+\frac{V_{pc}}{V_c}+\frac{V_{pe}}{V_c}+\frac{V_e}{V_c}\;\frac{[1+\cos(\theta+\phi)]}{2};\ \pi-\phi<\theta<\pi$$

$$V_t/V_c=\frac{V_{pe}}{V_c}+\frac{V_e}{V_c}\;\frac{[1+\cos(\theta+\phi)]}{2};\ \pi<\theta<2\pi$$

By adjusting the values of $V_e/V_c$, $V_{pe}/V_c$, $V_{pc}/V_c$ and $\phi$, the characteristics of the compression-expansion system can be varied. This flexibility is claimed as an unique feature of the proposed arrangement.

In general it is desirable to reduce the relative clearance volumes $V_{pc}/V_c$ and $V_{pe}/V_c$ to as small values as possible. Minimizing $V_{pc}/V_c$ maximizes the amount of air or air-fuel mixture delivered by the compression cylinder to the expansion cylinder for a given value of $V_c$. It also minimizes the loss associated with compression and reexpansion of the fluid contained in the clearance space. Minimizing $V_{pe}/V_c$ similarly minimizes the work required to compress the exhaust products to the compression pressure prior to opening of the transfer valve. Thus, for the purposes of illustration of the effects of $\phi$ and $V_e/V_c$, these clearance fractions are set at nominal values of $V_{pc}/V_c=V_{pe}/V_c=0.02$.

The three curves of FIG. (6) show the effect of the phase lead of the expander, denoted $\phi$, on the variation of total charge volume with crank angle, $\zeta$. Similarly FIG. (7) shows the effect of the ratio of expander displacement $V_e$ to compressor displacement $V_c$. Considering for example the curve for $\phi=30°$ in FIG. (6), the volume of the charge of air or air-fuel mixture is decreased with increasing $\theta$ up to point 1 at $\theta=150°$ where the transfer vlave opens. At this point the active charge becomes that originally in the compressor plus that in the expander so that $V_t$ increases, but as the two are at equal pressure when the valve opens, there will be no change in pressure until the combustion begins. From point 2 to point 3 the total volume first decreases slightly, then increases about twenty percent, and as combustion occurs the pressure will rise substantially. Thus, the transfer process with associated combustion approximates to the constant volume combustion desired for best efficiency. At point 3, as the compressor piston reaches its innermost position and reverses direction, the transfer valve closes and the effective volume becomes just that of the gas in the expander, so $V_t$ decreases to point 4. With increasing $\theta$, $V_t$ then increases to, in this case 1.5 times $V_c$. The effective compression ratio in this example is approximately 12, while the expansion ratio is about 18.

As the phase lead $\phi$ is reduced, for fixed $V_{pe}/V_c$ and $V_{pc}/V_c$, both the effective compression ratio and the effective expansion ratio increase, as exemplified by the curve for $\phi=10°$. In addition the transfer process occurs more nearly at constant volume.

The variation of compression ratio with phase lead $\phi$ is shown in FIG. (8) for $V_{pe}=V_{pc}=0.02$ and $V_e/V_c=1.5$. It can be seen that to achieve effective compression ratios of 10 or more, the phase lead should not exceed approximately 35 degrees.

The best choice of $\phi$ will depend on the application of the SCEE. If efficiency is the principal criterion for optimization, an effective compression ratio in the range of 15 to 20 will be desired, in which case $\phi$ should lie in the range of 20 to 25 degrees. If power per unit of weight is critical a lower compression ratio and correspondingly larger value of $\phi$ will be best.

I claim as my invention:

1. An internal combustion engine comprising at least one pair of a compressor and an expander positive displacement devices connected by a transfer passage, the passage controlled by a transfer valve, which allows passage of a gas after compression thereof from the compressor to the expander and is closed during expansion and recompression in the expander to prevent a flow of combusted gas into the compressor, said engine having a means for adding a fuel to the gas prior to the transfer valve, and the displacement devices operating cooperatively, the compressor serving to ingest and compress the gas without combustion, the expander having a displacement at least equal to the compressor, and leading the compressor in their cooperative cyclical motion by about 10 to no greater than 35 degrees to give a desired compression ratio, serving to permit gas combustion without further compression and expansion of the combusted gas, and to recompress a remainder to a pressure nearly equal to the pressure generated by the compressor said recompressed remainder providing ignition by mixing with the gas compressed by the compressor during transfer into the expander.

2. An internal combustion engine as claimed in claim 1, wherein the gas is an air-fuel mixture formed prior to ingestion by the compression device, and wherein ignition is provided for steady running by mixing of the air-fuel mixture with hot recompressed combustion products, in the expansion device upon discharge from the transfer passage.

3. An internal combustion engine as claimed in claim 1, in which the compression device and expansion device are provided with thermal insulation.

4. An internal combustion engine as claimed in claim 1, wherein the gas is air and in which fuel is injected into and mixed with compressed air as it passes from the compressor through the transfer passage into the expander.

5. An internal combustion engine as claimed in claim 1, in which the transfer valve is mechanically actuated, the valve having a stem which is sealed against leakage by a bellows.

6. An internal combustion engine as claimed in claim 1, in which the compressor and expander devices are piston-cylinder mechanisms arranged with parallel axes so that the pistons are actuated by adjacent throw on a common crankshaft, the throw actuating the expander piston being advanced relative to that actuating the compressor piston to give the desired lead of the former; and wherein the engine further comprises an inlet valve, exhaust valve and wherein the transfer valve and passage are incorporated in a removable cylinder head.

7. The engine of claim 1 wherein the transfer valve is a pressure actuated valve.

8. An internal combustion engine as claimed in claim 1, further comprising an exhaust valve operated under timed control such that the timing of the transfer and exhaust valves are so arranged as to closely approximate reversible adiabatic compression from ambient pressure, followed by constant volume heat addition, followed by reversible adiabatic expansion to ambient pressure.

9. An internal combustion engine as claimed in claim 8 wherein the exhaust valve is also responsive to the pressure of the gas in the expander.

10. An internal combustion engine comprising in combination:

(a) at least one pair of a compressor cylinder and an expander cylinder;

(b) at least one pair of a compressor piston and an expander piston disposed in their respective cylinders and connected to a common crankshaft for reciprocating motion to convert the effects of gas expansion in the expander cylinder into mechanical force, the compressor piston and cylinder cooperating to ingest and compress a gas without combustion, the expander piston and cylinder cooperating to permit gas combustion and expansion of the combusted gas without further compression, the expander piston leading the associated compressor piston in their relative motion by about 10 to no greater than 35 degrees;

(c) inlet valve means for supplying the gas into the compressor cylinder whereby the gas is compressed by the compressor piston during its reciprocating motion;

(d) transfer means for transferring the compressed gas from the compressor cylinder to the expander cylinder wherein combustion and expansion of the gas occurs during the transferring, the transfer means comprising a transfer valve which allows passage and combustion of a gas after compression thereof during transfer from the compressor cylinder to the expander cylinder and which valve is closed during expansion and recompression of the combusted gas in the expander cylinder to prevent a flow of the combusted gas into the compressor cylinder;

(e) means for adding a fuel to the gas prior to the transfer valve; and (f) exhaust valve means for removing a portion of the combusted gas from the expander cylinder while permitting a second portion to be recompressed.

11. The engine of claim 10 wherein the expander cylinder has a displacement at least as great as the compressor cylinder.

12. The engine of claim 10 wherein the expander cylinder has a displacement greater than the compressor cylinder.

13. The engine of claim 10 wherein the inlet valve means comprises a means for introducing a fuel and air mixture.

14. The engine of claim 10 wherein the inlet valve means comprises a means for introducing air and the transfer means further comprises a means for injecting a fuel.

15. The engine of claim 1 wherein the compressor piston leads the expander piston by about 15 to 30 degrees in their respective motion about the crankshaft.

16. The engine of claim 10 wherein the transfer valve is a pressure actuated valve.

17. The engine of claim 10 wherein the transfer means further comprises a passageway and a mechanical valve synchronized with the reciprocating motion of the pistons.

18. The engine of claim 17 wherein the mechanical valve further comprises a seat and stem, sealed against leakage by a bellows.

19. The engine of claim 18 wherein the engine further comprises a cooling means for removing heat from the cylinders.

* * * * *